US010151019B2

(12) United States Patent
Araoka et al.

(10) Patent No.: US 10,151,019 B2
(45) Date of Patent: Dec. 11, 2018

(54) HIGH-STRENGTH TITANIUM ALLOY MEMBER AND PRODUCTION METHOD FOR SAME

(75) Inventors: Yuji Araoka, Yokohama (JP); Tohru Shiraishi, Yokohama (JP); Yoshiki Ono, Yokohama (JP)

(73) Assignee: NHK SPRING CO., LTD., Kanagawa (JP)

( * ) Notice: Subject to any disclaimer, the term of this patent is extended or adjusted under 35 U.S.C. 154(b) by 972 days.

(21) Appl. No.: 13/817,087

(22) PCT Filed: Aug. 15, 2011

(86) PCT No.: PCT/JP2011/068812

§ 371 (c)(1), (2), (4) Date: Feb. 14, 2013

(87) PCT Pub. No.: WO2012/023620

PCT Pub. Date: Feb. 23, 2012

(65) Prior Publication Data

US 2013/0149183 A1 Jun. 13, 2013

(30) Foreign Application Priority Data

Aug. 20, 2010 (JP) ..... 2010-184838

(51) Int. Cl.
*B22F 1/00* (2006.01)
*B22F 3/14* (2006.01)
(Continued)

(52) U.S. Cl.
CPC ..... *C22C 14/00* (2013.01); *B22F 1/004* (2013.01); *B22F 1/0081* (2013.01);
(Continued)

(58) Field of Classification Search
None
See application file for complete search history.

(56) References Cited

U.S. PATENT DOCUMENTS 4,634,478 A * 1/1987 Shimogori et al. ..... 148/421
5,662,745 A * 9/1997 Takayama ..... C22F 1/183 123/188.3
(Continued)

FOREIGN PATENT DOCUMENTS

EP 2719781 A1 4/2014
EP 2719782 A1 4/2014
(Continued)

OTHER PUBLICATIONS

H. Xin, C. Hu, T. N. Baker. "Microstructural assessment of laser nitride Ti—6Al—4V alloy." Journal of Materials Science 35 (2000) 3373-3382.*
(Continued)

*Primary Examiner* — Paul A Wartalowicz
*Assistant Examiner* — Stephani Hill
(74) *Attorney, Agent, or Firm* — Oliff PLC

(57) ABSTRACT

A production method for a titanium alloy member includes preparing a titanium alloy material for sintering as a raw material of a sintered body; nitriding the titanium alloy material for sintering, thereby forming a nitrogen compound layer and/or a nitrogen solid solution layer in a surface layer of the titanium alloy material for sintering and yielding a nitrogen-containing titanium alloy material for sintering; mixing the titanium alloy material for sintering and the nitrogen-containing titanium alloy material for sintering, thereby yielding a titanium alloy material for sintering mixed with nitrogen-containing titanium alloy material; sintering the titanium alloy material for sintering mixed with nitrogen-containing titanium alloy material, thereby bonding the material each other and dispersing nitrogen contained in the nitrogen-containing titanium alloy material for sintering in a condition in which nitrogen is uniformly
(Continued)

dispersed into an entire inner portion of the sintered body by solid solution.

10 Claims, 4 Drawing Sheets

(51) Int. Cl.

| | |
|---|---|
| ***B22F 3/24*** | (2006.01) |
| ***C22F 1/18*** | (2006.01) |
| ***C23C 8/02*** | (2006.01) |
| ***C23C 8/24*** | (2006.01) |
| ***C23C 8/80*** | (2006.01) |
| ***C22C 14/00*** | (2006.01) |
| ***C22C 47/14*** | (2006.01) |
| ***C22C 49/11*** | (2006.01) |

(52) U.S. Cl.
CPC ..... *B22F 1/0088* (2013.01); *B22F 3/14* (2013.01); *B22F 3/24* (2013.01); *C22C 47/14* (2013.01); *C22C 49/11* (2013.01); *C22F 1/183* (2013.01); *C23C 8/02* (2013.01); *C23C 8/24* (2013.01); *C23C 8/80* (2013.01); *B22F 2003/248* (2013.01)

(56) References Cited

U.S. PATENT DOCUMENTS

| | | | | |
|---|---|---|---|---|
| 5,759,484 | A * | 6/1998 | Kashii | C22C 14/00 148/421 |
| 6,063,211 | A | 5/2000 | Soeda et al. | |
| 2004/0035503 | A1 | 2/2004 | Fujii et al. | |
| 2007/0007281 | A1 * | 1/2007 | Tetyukhin | C22F 1/183 219/615 |
| 2014/0112819 | A1 | 4/2014 | Shiraishi et al. | |
| 2014/0212319 | A1 | 7/2014 | Shiraishi et al. | |

FOREIGN PATENT DOCUMENTS

| | | |
|---|---|---|
| JP | A-05-272526 | 10/1993 |
| JP | A-08-157987 | 6/1996 |
| JP | 2000-096208 | 4/2000 |
| JP | B2-3426605 | 5/2003 |
| JP | A-2007-113120 | 5/2007 |
| JP | B2-4303821 | 7/2009 |
| WO | WO 96/33292 A1 | 10/1996 |

OTHER PUBLICATIONS

H. Matsumoto, K. Kodaira, K. Sato, T. J. Konno, A. Chiba. "Microstructure and mechanical properties of α' martensite type Ti alloys deformed under the α' processing." Materials Transactions, vol. 50, No. 12 (2009) pp. 2744-2750.*

J. C. Oh, S. Lee, M. G. Golkovski. Metallurgical and Materials Transactions A, vol. 32A, Dec. 2001, 2995-3005. (Year: 2001).*

ASTM F1472-14 (Year: 2014).*

Nov. 22, 2011 International Search Report issued in International Application No. PCT/JP2011/068812.

Aug. 26, 2015 Search Report issued in European Patent Application No. 11818260.9.

Jun. 11, 2014 Office Action issued in Japanese Patent Application No. 2010-184838 (with translation).

"Titanium A Technical Guide," Matthew J. Donachie, Jr., 2nd Edition, pp. 20, 203-205.

Apr. 7, 2017 Office Action issued in European Application No. 11818260.9.

* cited by examiner

Photograph1 Sample No.101
(Plate-like structure)

Photograph2 Sample No.204
(Fine acicular structure)

Photograph3 Comparative Sample No.1
(Isometric structure)

Photograph4 Comparative Sample No.2
(Fine acicular structure)

HIGH-STRENGTH TITANIUM ALLOY MEMBER AND PRODUCTION METHOD FOR SAME

TECHNICAL FIELD

The present invention relates to a high-strength titanium alloy member used in parts that are required to be light in weight and high in strength, and relates to a production method therefor.

BACKGROUND ART

Titanium alloys are light in weight and high in strength and are used in various fields of parts in which light weight is important, such as aircraft parts and automobile parts. Titanium alloys are superior in corrosion resistance and biocompatibility and are widely used in a field of bioimplant devices. In any of these fields, α-β type titanium alloys, typically exemplified by Ti-6Al-4V, are common since the alloys have high strength and broad utility and are low in cost.

Development of increased strength in α-β type titanium alloys that have high practical utility due to low cost are actively pursued. For example, Japanese Patent Unexamined Publication No. 5-272526 discloses a technique in which Ti-6Al-4V is subjected to gas nitride and a brittle TiN compound surface layer is removed, thereby improving fatigue strength. Japanese Patent Unexamined Publication No. 2000-96208 discloses a technique in which a first layer of a nitrogen solid solution hard layer and a second layer of an oxygen solid solution hard layer are formed simultaneously on pure Ti or Ti-6Al-4V, thereby hardening a surface of the member. Japanese Patent No. 4303821 discloses a composite material in which TiC compound is dispersed in Ti-6Al-4V.

On the other hand, β type titanium alloys also may be exemplified as a high-strength titanium alloy. However, β type titanium alloys include large amounts of rare metals, and materials for forming parts are expensive compared to α-β type titanium alloys. Although static strengths of β type titanium alloys can be improved by aging (precipitating) hardening, fatigue strength is insufficient compared to static strength. Precipitated phases having high hardnesses formed by heat treatment improve static strength. However, difference of hardness (elastic strain) between the precipitated phase and the matrix of the β phase is large, and the boundary between the precipitated phase and β phase may be initiation of breakage in fatigue in which cycle stress is loaded.

DISCLOSURE OF THE INVENTION

In the techniques disclosed in Japanese Patent Unexamined Publication No. 5-272526 and Japanese Patent Unexamined Publication No. 2000-96208, a surface of a member is merely highly strengthened, but it is difficult to strengthen an inner portion thereof. Therefore, although these techniques are effective to improve wear resistance and inhibit generation of fatigue cracks on the surface, they are not effective to improve static strength and inhibit extension of fatigue cracks. In the technique disclosed in Japanese Patent No. 4303821, a titanium alloy powder and a TiC compound powder are mixed, compacted, and sintered. It is difficult to uniformly mix the powders which have different specific gravity, so that the metallic structure after sintering is not uniform.

In Japanese Patent Unexamined Publication No. 2000-96208, the alloy contains a second layer of an oxygen solid solution hard layer in which oxygen as an α-stabilizing element as well as nitrogen. Although oxygen is an α-stabilizing element as well as nitrogen, oxygen easily forms a hard and brittle a case (α-stabilizing element rich layer) compared to nitrogen. Therefore, it is difficult to control stably forming only the oxygen solid solution hard layer in a production process. It is known that function of oxygen for highly strengthening is lower than that of nitrogen.

Thus, although development of highly strength titanium alloys by utilizing nitrogen has been made, there has not been provided a technique in which a member is highly strengthened in the entirety to the inner portion. Therefore, an object of the present invention is to provide a high-strength titanium alloy member, and a production method therefor, in which an inner portion of the member is highly strengthened as well as a surface layer.

The present invention provides a production method for titanium alloy member, the method comprising: preparing a titanium alloy material for sintering as a raw material of a sintered body; nitriding the titanium alloy material for sintering, thereby forming a nitrogen compound layer and/or a nitrogen solid solution layer in a surface layer of the titanium alloy material for sintering and yielding a nitrogen-containing titanium alloy material for sintering; mixing the titanium alloy material for sintering and the nitrogen-containing titanium alloy material for sintering, thereby yielding a titanium alloy material for sintering mixed with nitrogen-containing titanium alloy material; sintering the titanium alloy material for sintering mixed with nitrogen-containing titanium alloy material, thereby bonding the material together and dispersing nitrogen contained in the nitrogen-containing titanium alloy material for sintering in a condition in which nitrogen is uniformly dispersed into the entire inner portion of the sintered body by solid solution.

According to the present invention, the sintering yields a titanium alloy member in which nitrogen contained in the nitrogen-containing titanium alloy material for sintering is uniformly dispersed into the entire inner portion of the sintered body by solid solution. Therefore, a titanium alloy member that is highly strengthened overall is produced. In contrast, if nitrogen compounds such as TiN compound are formed, difference of hardness (or elastic strain) between the highly hardened TiN compound phase and the matrix is large, the boundary thereof may be initiation of breakage in fatigue in which cycle stress is loaded. On the other hand in the present invention, nitrogen is contained in solid solution, whereby there is no boundary having large difference in hardness and readily being an initiation of breakage between the highly hardened phase such as a nitrogen compound and the matrix, and fatigue strength is improved.

The high-strength titanium alloy member of the present invention is produced by the above-mentioned production method, the member comprising: a plate-like structure; and 0.02 to 0.09 mass % of nitrogen contained in solid solution. In the high-strength titanium alloy member, since the member contains 0.02 mass % or more of nitrogen, the member is highly strengthened overall and fatigue strength is improved. It should be noted that if amount of nitrogen exceeds 0.09 mass %, ductility may be greatly lowered and there may be embrittlement. Therefore, the amount of nitrogen is 0.02 to 0.09 mass %.

In the present invention, the high-strength titanium alloy member after the sintering may be subjected to solution heat treatment and annealing treatment, thereby obtaining a fine acicular structure that is heat-stable and uniform. By forming a fine acicular structure which is heat-stable and uniform, the amount of nitrogen can be up to 0.12 mass % while inhibiting brittleness and achieving further high-strength and high-fatigue strength. Therefore, the present invention is a high-strength titanium alloy member comprising: a fine acicular structure; and 0.02 to 0.12 mass % of nitrogen contained in solid solution.

Effects of the Present Invention

According to the present invention, a high-strength titanium alloy member that is highly strengthened overall by containing nitrogen in solid solution in an α-β type titanium alloy having broad utility is provided.

EMBODIMENT OF THE INVENTION

Figure 1A:
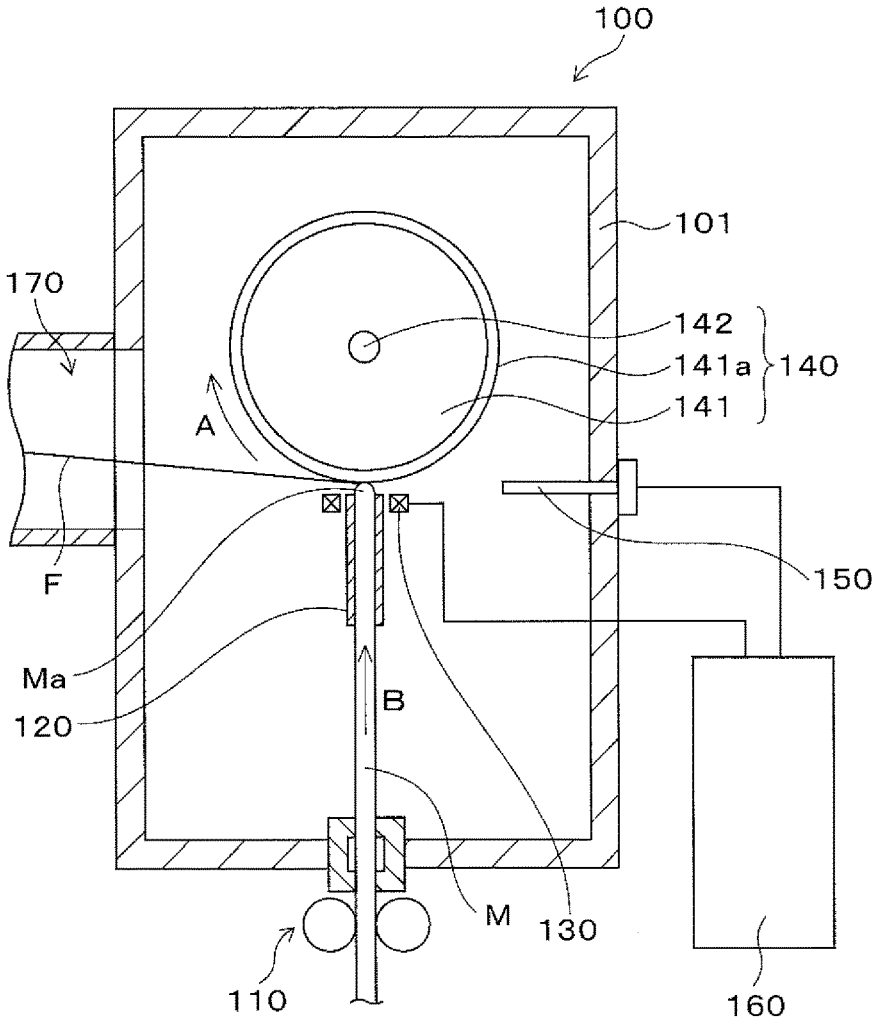
FIGS. 1A and 1B show a production apparatus for metallic fiber used in an embodiment of the present invention.

Powders, thin strips, thin pieces, and fibers may be used as a titanium alloy material for sintering. Among these forms, a thin strip, a thin piece, and a fiber are preferable since these forms are suitable for handling while considering safety and operation efficiency compared to a powder. These forms can easily be the same size, whereby control in nitriding can be easy. That is, a thin strip, a thin piece, and a fiber are preferable since the amount of nitrogen can be easily controlled. Among these forms, fibers that are obtained by production methods for woven cloth and unwoven cloth are more preferable since a titanium alloy material for sintering and a nitrogen-containing titanium alloy material for sintering can be uniformly mixed. That is, nitrogen can be easily dispersed uniformly overall. Specifically, titanium alloy fibers obtained by a molten metal extraction method are most preferable since the fiber has superior cleanliness.

Sintering may preferably performed by HP (Hot Press), HIP (Hot Isostatic Press), SPS (Spark Plasma Sintering) which have a compressing mechanism and enable sintering in vacuum or inert gas atmosphere. By heating at a sintering temperature and compressing the titanium alloy material for sintering mixed with nitrogen-containing titanium alloy material, a high-strength titanium alloy member in which few pores exist can be obtained.

The solution heat treatment in the present invention is a treatment in which the material is heated to a temperature proximate to the β transus temperature, and is rapidly cooled by a cooling medium. The heating temperature for an α-β type titanium alloy is preferably within 100° C. from the β transus temperature. By this treatment, a fine acicular structure mainly composed of α' phase (hexagonal martensitic crystal) is obtained. When the heating temperature exceeds 100° C. from the β transus temperature, β phase may be coarse in heating, thereby precipitating coarse α phase at grain boundaries after cooling. As a result, ductility of the member is greatly reduced. When the heating temperature is lower than 100° C. from the β transus temperature, transformation of an α phase into a β phase in heating is insufficient, whereby a large amount of coarse α phase is remained and required strength is not obtained.

The annealing treatment in the present invention performed after the solution heat treatment is a treatment in which supersaturated solid solutions such as an α' phase which is hard, brittle, and thermally unstable are suitably recovered and resolved, whereby the structure is thermally stable and mechanical properties are improved by fine precipitated phases. The heating temperature in an α-β type titanium alloy is preferably 450 to 750° C. By this treatment, a fine α phase is precipitated in the residual β phase and the α' phase is resolved into fine α phase and β phase, whereby the member is thermally stable and ductility is improved. When the heating temperature is less than 450° C., the structure is not easily resolved. When the heating temperature is more than 750° C., the structure is thermally stable, but the grain is coarse. It should be noted that the structure after the solution heat treatment is not thermally stable, but the structure is fine and strengthened by nitrogen solid solution, whereby the strength is sufficiently high compared to members composed of a plate-like structure before solution heat treatment and aging (precipitating) hardened β type titanium alloy members. Therefore, if thermal stability is negligible in practical use, the annealing treatment can be omitted.

The fine acicular structure preferably includes an acicular crystal of which a thickness is 5 μm or less. By forming such a fine acicular structure, the member has high strength due to the fine crystal grain and high resistance to extension of cracks due to the acicular structure, and fatigue strength is sufficiently improved.

The fine acicular structure preferably includes a β phase of which an area ratio is 1.0% or less. Since the β phase is low in strength, the member has further high strength and high fatigue strength by limiting the area ratio of the β phase to 1.0% or less.

The raw material for the high-strength titanium alloy member of the present invention is preferably widely used α-β type titanium alloy, and Ti-6Al-4V, Ti-3Al-2.5V, Ti-4Al-3Mo-1V, Ti-5Al-2Cr-1Fe, Ti-5Al-1.5Fe-1.5Cr-1.5Mo, Ti-6Al-2Nb-1Ta-1Mo, Ti-8Al-1Mo-1V, Ti-8Al-4Co, Ti-6Al-2Sn-4Zr-2Mo, Ti-6Al-6V-2Sn, and Ti-6Al-2Sn-4Zr-6Mo are exemplified.

The high-strength titanium alloy member of the present invention can be applied to aircraft parts and automobile parts in which light weight is required, specifically, the member is suitable for parts in which strength is required. Titanium alloys are superior in biocompatibility and can be used as a material for bioimplant devices. Specifically, the alloys are suitable for devices that are required to have strength since the effect of lightness of weight is great.

Production method of the high-strength titanium alloy member of the present invention will be explained in detail hereinafter.

1. Step for Forming Fiber

Figure 1B:
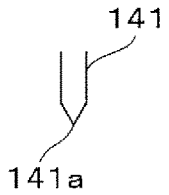

FIGS. 1A and 1B show schematic structure of a production apparatus for metallic fiber 100 (hereinafter referred to simply as "apparatus 100") for performing a step for forming a fiber in an embodiment of the present invention, FIG. 1A shows a cross sectional view of the entire apparatus 100 and FIG. 1B shows a cross sectional view of a circumferential portion 141*a* of a rotating disk 141. FIG. 1B is a side sectional view in a direction perpendicular to the plane of the paper.

The apparatus 100 is a production apparatus for metallic fiber using a molten metal extraction method. In the apparatus 100 using a molten metal extraction method, an upper end portion of a rod-shaped raw material M is melted, and a molten metal Ma contacts the circumferential portion 141*a* of the rotating disk 141, a portion of the molten metal Ma is extracted toward the direction of the substantially tangential line of the circumference of the disk 141, and is rapidly cooled, thereby forming a titanium alloy fiber F. For example, a titanium alloy such as Ti-6Al-4V is used as a raw material M, and a titanium alloy fiber F having a diameter of 10 to 200 μm is produced. The diameter of the titanium alloy fiber F is not limited, and the diameter is selected according to the amount of nitrogen that should be contained in the titanium alloy member. For example, if a large amount of nitrogen should be contained, the diameter of the titanium alloy fiber F may be thin. In this case, the proportion of a nitrogen compound layer and/or a nitrogen solid solution layer which are formed by the nitriding can be increased with respect to the diameter.

As shown in FIG. 1A, the apparatus 100 includes a chamber 101 which can be sealed. A raw material feeding portion 110, a raw material holding portion 120, a heating portion 130, a disk rotating portion 140, a temperature measuring portion 150, a high-frequency generating portion 160, and a metallic fiber receiving portion 170 are provided in the chamber 101.

An inert gas such as argon gas is provided in the chamber 101 as an atmosphere gas, thereby inhibiting reaction of impurities such as oxygen included in an atmosphere gas and a molten material Ma. The raw material feeding portion 110 is located at the bottom of the chamber 101, feeds the raw material M toward the direction of the arrow B at predetermined speed, and provides the raw material M to the raw material holding portion 120. The raw material holding portion 120 prevents movement of the molten material Ma toward a radial direction thereof and guides the raw material M toward a suitable position of the disk rotating portion 140.

The raw material holding portion 120 is a water cooled tubular member made from a metal and is located between the raw material feeding portion 110 and the metallic fiber-forming portion 140 and below the disk 141. The heating portion 130 is a high-frequency induction coil which generates magnetic flux for melting the upper portion of the raw material M and forming the molten material Ma. As a material for the raw material holding portion 120, a material that has high thermal conductivity for cooling effect by a cooling water and is not magnetic to avoid effects of generating magnetic flux is preferable. Copper or a copper alloy is preferable as a material for the raw material holding portion 120 for practical use.

The disk rotating portion 140 produces a titanium alloy fiber F from the molten material Ma by the disk 141 which rotates around a rotating shaft 142. The disk 141 is made from copper or a copper alloy having high thermal conductivity. As shown in FIG. 1B, a V-shaped circumference 141*a* is formed on the circumferential portion of the disk 141.

The temperature measuring portion 150 measures the temperature of the molten material Ma. The high-frequency generating portion 160 provides high-frequency current to the heating portion 130. The power of the high-frequency generating portion 160 is controlled based on the temperature of the molten material Ma which is measured by the temperature measuring portion 150, and the temperature of the molten material Ma is maintained to be constant. The metallic fiber receiving portion 170 receives the metallic fiber F which is formed by the metallic fiber fainting portion 140.

In the above apparatus, the raw material feeding portion 110 continually feeds the raw material M in a direction of the arrow B, thereby supplying it to the raw material holding portion 120. The heating portion 130 melts the upper portion of the raw material M by induction heating, thereby forming the molten material Ma. Then, the molten material Ma is continually fed to the circumference 141*a* of the disk 141 rotating in the direction of the arrow A, the molten material Ma contacts the circumference 141*a* of the disk 141, a part thereof is extracted toward a direction of an approximate tangential line of the circle of the disk 141 and is rapidly cooled, thereby forming a titanium alloy fiber (titanium alloy material for sintering) F. The formed titanium alloy fiber F extends toward the direction of an approximate tangential line of the circle of the disk 141 and received by the metallic fiber receiving portion 170 which is located in the direction in which the fiber F extends.

2. Nitriding Step

As an embodiment of a nitriding step, an aggregate of the titanium alloy fiber F produced by the above process is carried into a vacuum furnace, which is evacuated and supplied with a nitrogen gas, and the fiber F is heated. In this case, an inert gas such as argon gas may be supplied with nitrogen gas for adjusting the density and the pressure of the nitrogen gas. The pressure and the temperature in the furnace and processing time are suitably selected according to amount of nitrogen which should be contained in a titanium alloy member. If the temperature of the furnace is too low, a very long time is required to form a nitrogen compound layer and/or a nitrogen solid solution layer. If the temperature of the furnace is too high, control of the processing time is difficult since reaction speed is high, and a thick nitrogen compound layer is readily formed. The thick nitrogen compound layer requires a very long time for dispersing nitrogen in following sintering step. Therefore, the temperature in the furnace is preferably 600 to 1000° C. for practical production. By the nitriding step, a nitrogen-containing titanium alloy fiber (nitrogen-containing titanium alloy material for sintering) G in which a very thin TiN compound layer and/or nitrogen solid solution layer is formed on the titanium alloy fiber F is produced.

3. Mixing Step

Figure 2A:
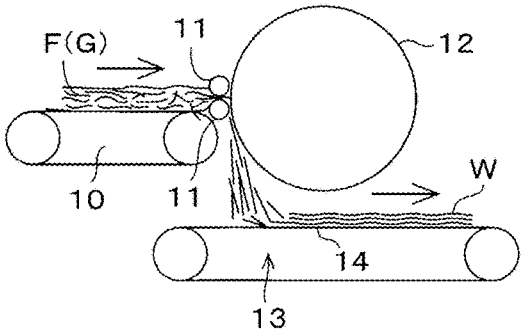
FIGS. 2A and 2B show a fiberizing apparatus used in an embodiment of the present invention.
Figure 2B:
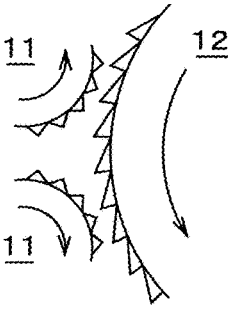

The nitrogen-containing titanium alloy fiber G including nitrogen by the above manner and the titanium alloy fiber F which does not contain nitrogen are mixed with predetermined percentage according to required nitrogen amount. As a mixing apparatus, a fiberizing apparatus shown in FIG. 2 is used. As shown in FIG. 2, an aggregation of the titanium alloy fiber F and an aggregation of the nitrogen-containing titanium alloy fiber G are layered together and supplied to a material conveyer 10, and are moved to the exit side. A feed roller 11 is located at the exit of the material conveyer 10. A fiberizing mechanism 12 is located out of the feed roller 11. As shown FIG. 2B, plural teeth are formed on the circumference of the feed roller 11, which bites and feeds the nitrogen-containing titanium alloy fiber G and the titanium alloy fiber F. Plural teeth are also formed on the circumference of the fiberizing mechanism 12, which combs a part of the nitrogen-containing titanium alloy fiber G and the titanium alloy fiber F which are bitten by the feed roller 11, and drops it on a belt 14 of a conveyer 13. In this condition, the nitrogen-containing titanium alloy fiber G and the titanium alloy fiber F are broken and mixed, and are piled up on the belt 14 as an aggregation of random fibers without orientation in a plane, thereby forming a fiber aggregation of titanium alloy material mixed with nitrogen-containing titanium alloy material (titanium alloy material for sintering mixed with nitrogen-containing titanium alloy material) W. As apparatuses for mixing other than the fiberizing apparatus shown in FIG. 2A, several kinds of apparatus can be used. For example, unwoven fabric forming machines such as card type and aeration type and mixing machines such as mixers and mills can be used.

4. Sintering Step

In a vacuum HP apparatus, a heating chamber is disposed in a vacuum vessel, a mold is disposed in the heating chamber, a cylinder is disposed in the upper portion of the vacuum vessel, a press ram projected from the cylinder is vertically movable in the heating chamber, and an upper punch installed at the press ram is inserted into the mold. The fiber aggregation of titanium alloy material mixed with nitrogen-containing titanium alloy material W is charged into the mold of the HP apparatus constructed as above, the vacuum vessel is evacuated or purged with an inert gas, and the heating chamber is heated to a predetermined sintering temperature. Then, the fiber aggregation of titanium alloy material mixed with nitrogen-containing titanium alloy material W is compressed by the upper punch inserted into the mold, and is sintered.

The sintering should be performed in a vacuum or an inert gas atmosphere to avoid contamination by impurities such as oxygen from the atmosphere into a titanium alloy member. The sintering temperature is preferably 900° C. or more, the sintering time is preferably 30 minutes or more, the pressure of press is preferably 10 MPa or more. By the sintering step, the fiber aggregation of titanium alloy material mixed with nitrogen-containing titanium alloy material W may be a densified titanium alloy member in which few pores exist. Nitrogen contained in the nitrogen-containing titanium alloy fiber G is uniformly dispersed into the titanium alloy member in solid solution overall, and nitrogen compound is not contained. In this case, the structure without a nitrogen compound is a plate-like structure.

5. Solution Heat Treatment and Annealing Treatment

Solution heat treatment and annealing treatment can be performed in a typical heating furnace in air. In solution heat treatment, the material is preferably rapidly cooled by a cooling medium such as water and oil after heating. In annealing treatment, cooling conditions after heating are not limited, and natural cooling or air stream cooling is typically performed.

EXAMPLES

1. Production of Samples

The present invention will be explained in detail by way of specific examples. A titanium alloy fiber of which average diameter was 60 μm was produced from Ti-6Al-4V (corresponding to ASTM B348 Gr. 5) as a raw material using the apparatus 100.

A part of the titanium alloy fiber was subjected to nitriding. In the nitriding, the titanium alloy fiber was carried into a vacuum furnace. After evacuating, a nitrogen gas was fed into the vacuum furnace, and the pressure in the furnace was set at 600 Torr. Then, the temperature in the furnace was increased to 800° C. and maintained for 1.5 hours.

The nitrogen-containing titanium alloy fiber that was subjected to nitriding such as above and the titanium alloy fiber that did not contain nitride were supplied to the fiberizing apparatus shown in FIGS. 2A and 2B, both were mixed and a fiber aggregation of titanium alloy material mixed with nitrogen-containing titanium alloy material was obtained. The weight percentage (Wf) of the mixed nitrogen-containing titanium alloy fiber is shown in Table 1.

The fiber aggregation of titanium alloy material mixed with nitrogen-containing titanium alloy material was charged into a mold made from carbon, and was sintered in a vacuum HP apparatus, thereby obtaining a titanium alloy member having 10 mm thickness (Samples Nos. 101 to 214). In the sintering, the degree of vacuum was $1\times10^{-4}$ Torr or less, the temperature was increased to a predetermined sintering temperature at a heating rate of 10° C./minute, and then the sample was compressed at a pressure of 40 MPa for 1.5 hours, which may have been a sufficient pressure and maintaining time for forming a further densified body. Cooling after sintering was performed in the furnace. The mold made from carbon and the fiber aggregation of titanium alloy material mixed with nitrogen-containing titanium alloy material as well as the titanium alloy member which is a sintered body of the fiber are reactive under the high temperature conditions of the examples. Therefore, a release plate as a liner made from alumina (purity of 99.5% or more) was installed to the carbon mold. However, in Samples Nos. 114 and 214 in which the sintering temperature was 1400° C., since the titanium alloy member after sintering and the release plate were completely bonded together, a sample for evaluation could not be selected. Therefore, Samples Nos. 114 and 214 were not evaluated.

A part of the titanium alloy member was subjected to solution heat treatment and annealing treatment in this order as a heat treatment. In the solution heat treatment, the titanium alloy material was heated to 1040° C. and maintained for 2 hours, and then it was cooled in iced water. In the annealing treatment, the titanium alloy material was heated to 550° C. and maintained for 2 hours, and then it was cooled by air (these treatments are referred as "heat treatment" hereinafter, unless it is explicitly stated otherwise). It is shown in Table 1 whether the heat treatment was performed or not with respect to Samples Nos. 101 to 113 and Samples Nos. 201 to 213.

For comparison, an expanded material of Ti-6Al-4V (corresponding to ASTM B348 Gr. 5) was prepared, a part of which was subjected to the heat treatment with the same condition. The sample is shown together as Comparative Examples Nos. 1 and 2 in Table 1.

TABLE 1

| Sample | Wf (%) | Sintering temperature (° C.) | Heat treatment |
|---|---|---|---|
| No. 101 | 5 | 1100 | Not done |
| No. 102 | 10 | 1100 | Not done |
| No. 103 | 15 | 1100 | Not done |
| No. 104 | 20 | 1100 | Not done |
| No. 105 | 25 | 1100 | Not done |
| No. 106 | 30 | 1100 | Not done |
| No. 107 | 35 | 1100 | Not done |
| No. 108 | 40 | 1100 | Not done |
| No. 109 | 20 | 800 | Not done |
| No. 110 | 20 | 900 | Not done |
| No. 111 | 20 | 1000 | Not done |
| No. 112 | 20 | 1200 | Not done |
| No. 113 | 20 | 1300 | Not done |
| No. 114 | 20 | 1400 | — |
| No. 201 | 5 | 1100 | Done |
| No. 202 | 10 | 1100 | Done |
| No. 203 | 15 | 1100 | Done |

TABLE 1-continued

| Sample | Wf (%) | Sintering temperature (° C.) | Heat treatment |
|---|---|---|---|
| No. 204 | 20 | 1100 | Done |
| No. 205 | 25 | 1100 | Done |
| No. 206 | 30 | 1100 | Done |
| No. 207 | 35 | 1100 | Done |
| No. 208 | 40 | 1100 | Done |
| No. 209 | 20 | 800 | Done |
| No. 210 | 20 | 900 | Done |
| No. 211 | 20 | 1000 | Done |
| No. 212 | 20 | 1200 | Done |
| No. 213 | 20 | 1300 | Done |
| No. 214 | 20 | 1400 | — |
| Comparative sample No.1 | — | — | Not done |
| Comparative sample No.2 | — | — | Done |

2. Observation and Measuring Method (1) Observation of Structure

Figure 6:
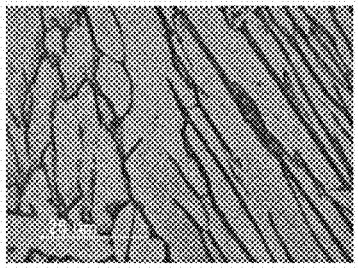
FIG. 6 shows photographs showing structures of titanium alloy materials in the example.
Figure 6:
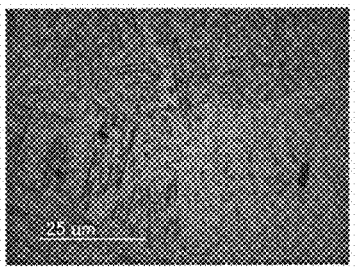
Figure 6:
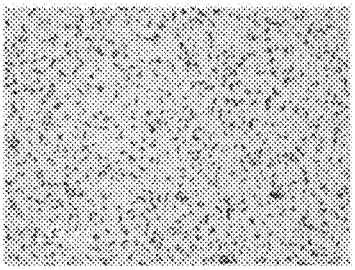
Figure 6:
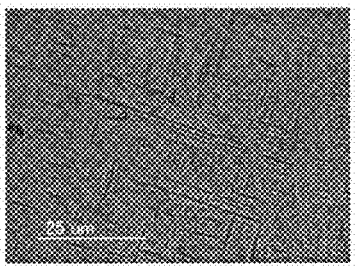

The samples were cut to a suitable size and embedded in a resin, mirror finished by mechanical polishing, etched by an etching fluid (2 wt % of hydrofluoric acid and 4 wt % of nitric acid), and structure was observed by an optical microscope (apparatus: NIKON ME 600). FIG. 6 shows microscope photographs of the samples.

(2) Amount of Nitrogen (N Amount)

Amount of nitrogen was measured by inert gas melting-thermal conductivity technique and solid state type infrared absorption method (apparatus: LOCO TC600).

(3) Existence of TiN Compound (TiN Phase)

Peak of TiN compound was observed by an X-ray diffractometer (apparatus: Rigaku X-ray DIIFFRACTOMETER RINT2000) using Cu tube target.

(4) Area Ratio of β Phase (β Phase Ratio)

β phase ratio was analyzed and calculated by FESEM/EBSD method (apparatus: JEOL JSM-7000F, TSL solutions OIM-Analysis Ver. 4.6) with 3000-power magnification.

(5) Hardness (HV)

Hardness of the surface and the center of samples were measured by a Vickers hardness tester (apparatus: FUTURE-TECH FM-600). The test load was 10 gf. The surface hardness was measured at 0.5 mm 10 points below the surface in the thickness direction and the center hardness was measured at the center 10 points in the thickness direction, and the average was calculated.

(6) Three-Point Bending Strength ($\sigma_b$)

Figure 3:
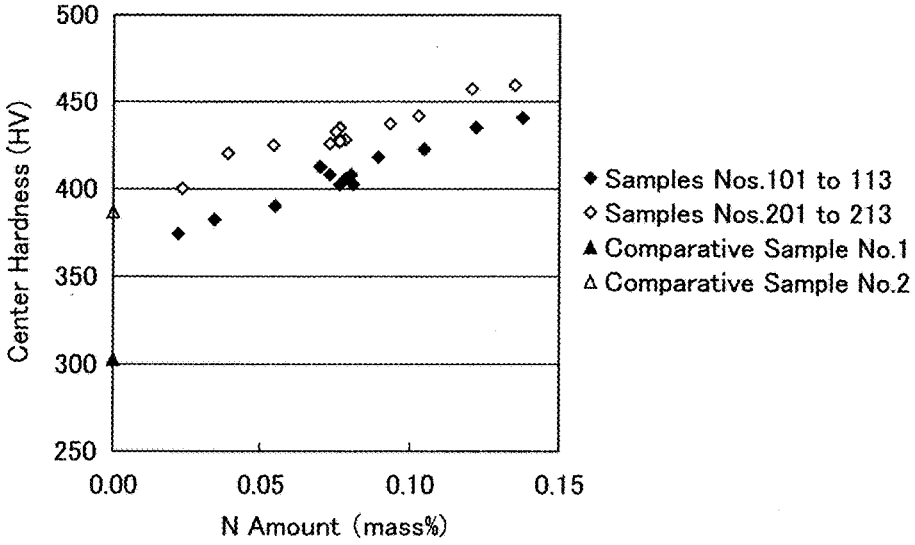
FIG. 3 shows a graph showing a relationship between amount of nitrogen and hardness of center portion in the example of the present invention.
Figure 4:
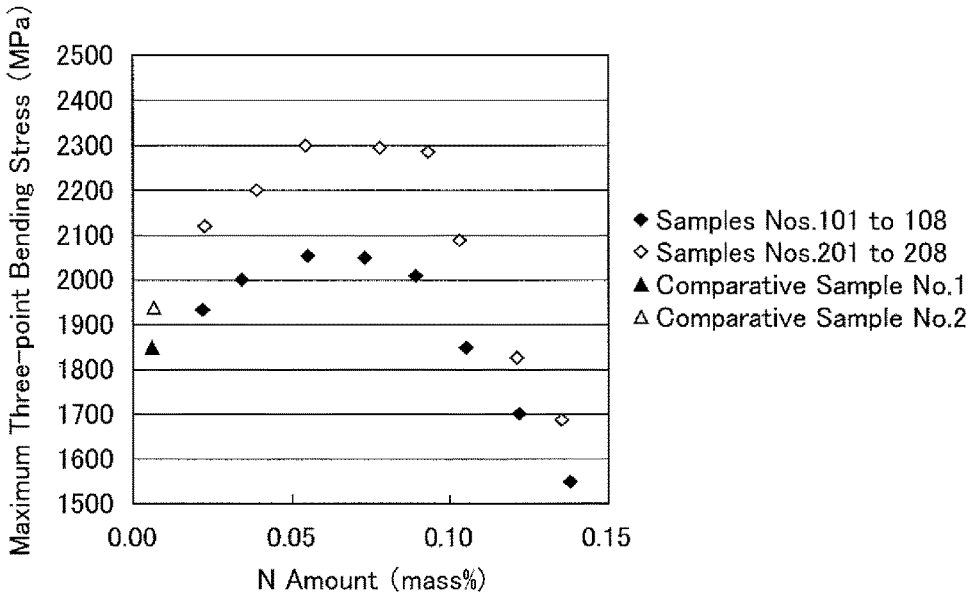
FIG. 4 shows a graph showing a relationship between amount of nitrogen and the maximum stress in three-point bend test in the example.
Figure 5:
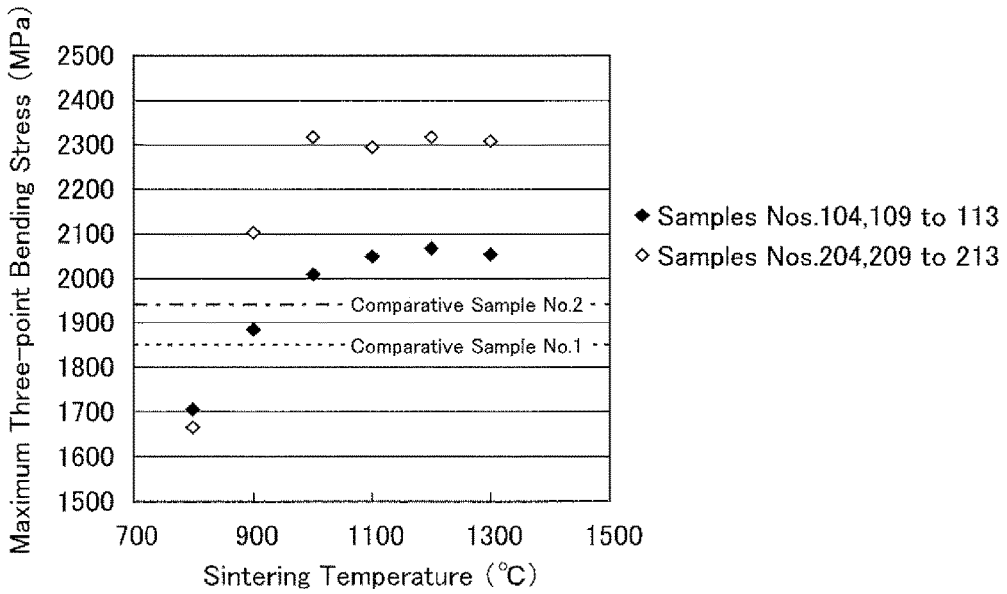
FIG. 5 shows a graph showing a relationship between sintering temperature and the maximum stress in three-point bend test in the example.

300 kN universal testing machine was used (apparatus: INSTRON 5586 type). The dimensions of the test piece were width: 6 mm, length: 17 mm, thickness: 1 mm, and the distance between fulcrums was 15 mm. The test speed was 6 mm/minutes, and the average of three measured values was calculated. The results of the structure observation, the analysis, and the test are shown in Table 2. The relationship between the nitrogen amount and the hardness is shown in FIG. 3, the relationship between the nitrogen amount and the maximum stress in the three-point bending is shown in FIG. 4, and the relationship between the sintering temperature and the maximum stress in the three-points bending is shown in FIG. 5. The above items prescribed in the parentheses are items described in Table 2.

TABLE 2

| Sample | Wf (%) | Sintering temperature (° C.) | Heat treatment | Structure | N amount (mass %) | TiN phase | Rate of β phase (%) | HV Surface | HV Center | $\sigma_b$ (MPa) |
|---|---|---|---|---|---|---|---|---|---|---|
| No. 101 | 5 | 1100 | Not done | Plate-like structure | 0.022 | Not recognized | 6.5 | 375 | 374 | 1935 |
| No. 102 | 10 | 1100 | Not done | Plate-like structure | 0.034 | Not recognized | 5.2 | 381 | 382 | 1998 |
| No. 103 | 15 | 1100 | Not done | Plate-like structure | 0.055 | Not recognized | 6.8 | 392 | 390 | 2055 |
| No. 104 | 20 | 1100 | Not done | Plate-like structure | 0.073 | Not recognized | 6.9 | 409 | 408 | 2050 |
| No. 105 | 25 | 1100 | Not done | Plate-like structure | 0.089 | Not recognized | 7.0 | 416 | 418 | 2010 |
| No. 106 | 30 | 1100 | Not done | Plate-like structure | 0.105 | Not recognized | 6.6 | 425 | 423 | 1850 |
| No. 107 | 35 | 1100 | Not done | Plate-like structure | 0.122 | Not recognized | 6.8 | 432 | 435 | 1700 |
| No. 108 | 40 | 1100 | Not done | Plate-like structure | 0.138 | Not recognized | 6.9 | 440 | 441 | 1550 |
| No. 109 | 20 | 800 | Not done | Plate-like structure | 0.076 | Not recognized | 6.2 | 401 | 403 | 1706 |
| No. 110 | 20 | 900 | Not done | Plate-like structure | 0.080 | Not recognized | 5.7 | 396 | 408 | 1882 |
| No. 111 | 20 | 1000 | Not done | Plate-like structure | 0.070 | Not recognized | 5.9 | 415 | 412 | 2007 |
| No. 112 | 20 | 1200 | Not done | Plate-like structure | 0.078 | Not recognized | 7.2 | 398 | 406 | 2067 |
| No. 113 | 20 | 1300 | Not done | Plate-like structure | 0.081 | Not recognized | 5.9 | 398 | 402 | 2055 |
| No. 201 | 5 | 1100 | Done | Fine acicular structure | 0.023 | Not recognized | 0.3 | 402 | 400 | 2120 |
| No. 202 | 10 | 1100 | Done | Fine acicular structure | 0.039 | Not recognized | 0.2 | 421 | 420 | 2200 |
| No. 203 | 15 | 1100 | Done | Fine acicular structure | 0.054 | Not recognized | 0.1 | 426 | 425 | 2298 |
| No. 204 | 20 | 1100 | Done | Fine acicular structure | 0.078 | Not recognized | 0.2 | 431 | 428 | 2296 |

TABLE 2-continued

| Sample | Wf (%) | Sintering temperature (° C.) | Heat treatment | Structure | N amount (mass %) | TiN phase | Rate of β phase (%) | HV Surface | HV Center | $\sigma_b$ (MPa) |
|---|---|---|---|---|---|---|---|---|---|---|
| No. 205 | 25 | 1100 | Done | Fine acicular structure | 0.093 | Not recognized | 0.4 | 435 | 437 | 2286 |
| No. 206 | 30 | 1100 | Done | Fine acicular structure | 0.103 | Not recognized | 0.7 | 441 | 442 | 2090 |
| No. 207 | 35 | 1100 | Done | Fine acicular structure | 0.121 | Not recognized | 0.5 | 453 | 457 | 1825 |
| No. 208 | 40 | 1100 | Done | Fine acicular structure | 0.135 | Not recognized | 0.6 | 463 | 460 | 1688 |
| No. 209 | 20 | 800 | Done | Fine acicular structure | 0.076 | Not recognized | 0.1 | 435 | 435 | 1666 |
| No. 210 | 20 | 900 | Done | Fine acicular structure | 0.075 | Not recognized | 0.1 | 428 | 433 | 2103 |
| No. 211 | 20 | 1000 | Done | Fine acicular structure | 0.076 | Not recognized | 0.4 | 430 | 428 | 2316 |
| No. 212 | 20 | 1200 | Done | Fine acicular structure | 0.073 | Not recognized | 0.2 | 422 | 426 | 2318 |
| No. 213 | 20 | 1300 | Done | Fine acicular structure | 0.076 | Not recognized | 0.3 | 432 | 427 | 2308 |
| Comparative sample No. 1 | — | — | Not done | Equiaxed structure | 0.006 | Not recognized | 5.1 | 305 | 303 | 1850 |
| Comparative sample No. 2 | — | — | Done | Fine acicular structure | 0.007 | Not recognized | 0.3 | 385 | 387 | 1939 |

3. Evaluation

Samples Nos. 101 to 113 were sintered without heat treatment, whereby the structures thereof were plate-like structures as shown in FIG. 6 (Sample No. 101). In Samples Nos. 101 to 113, the amount of nitrogen increases as the rate of weight of the mixed nitrogen-containing titanium alloy fiber increases. As shown in FIG. 3, the hardness increases commensurate to the amount of nitrogen. On the other hand, in Comparative Sample No. 1 which was not subjected to the heat treatment and generally distributed as an expanded material, it may be assumed that annealing treatment performed in the expanding process affects, the structure was isometric crystals as shown in FIG. 6. As is apparent from FIG. 3, in Samples Nos. 101 to 113, the hardness was greatly increased compared to Comparative Sample No. 1 which was not subjected to heat treatment.

In Sample Nos. 201 to 213, the structures were acicular structures as shown in FIG. 6 (Sample No. 204) since they were subjected to the heat treatment, and the thickness of the fine acicular crystals was 5 μm or less. Therefore, the hardness was increased compared to Samples Nos. 101 to 113. On the other hand, in Comparative Sample No. 2 which was subjected to heat treatment and generally distributed as an expanded material, the structures were acicular structures since it was subjected to the heat treatment as shown in FIG. 6. As a result, the hardness was greater than Comparative Sample No. 1, but was greatly lower than that of Samples Nos. 201 to 213. Thus, in Samples Nos. 101 to 113 and Samples Nos. 201 to 213, which contained nitrogen, it was confirmed that the hardness was greatly increased.

As shown in Table 2, in Samples Nos. 101 to 113 and Samples Nos. 201 to 213, the hardness of the surface portion was the same as the hardness of the center portion, and the hardness was greatly increased compared to that of Comparative Samples Nos. 1 and 2. Therefore, in order to obtain high-strength overall toward the inner portion of a titanium alloy member, it is preferable to apply the method of the present invention.

According to the result of the x-ray diffraction test, peaks of nitrogen compounds such as TiN compound were not found. That is, it was confirmed that the contained nitrogen was not used for forming nitrogen compounds, but was used for solid solution formation.

According to the result of analysis of the electron backscatter diffraction pattern method, the area ratio of the β phase in Samples Nos. 101 to 113 was 5.2 to 7.2%. The area ratio of the β phase in Samples Nos. 201 to 213 was 0.1 to 0.7%. In Samples Nos. 201 to 213 which had an acicular structure, the strength was greatly increased since area ratio of the β phase was small compared to that of Samples Nos. 101 to 113 which had a plate-like structure. The area ratio of the β phase is preferably less than 1%.

Next, the relationship between amount of nitrogen and the maximum three-point bending stress will be validated referring to FIG. 4. In Sample No. 101 which contained 0.022 mass % of nitrogen, the maximum three-point bending strength was higher than that of Comparative Sample 1. The maximum three-point bending stress increased as amount of nitrogen increased. However, in Sample No. 106 that contained 0.105 mass % of nitrogen, the material was embrittled due to reduction of ductility, the maximum three-point bending stress was the same as that of Comparative Sample No. 1. In the cases in which nitrogen was further contained, the maximum three-point bending stress further decreased due to further embrittlement. When the amount of nitrogen was less than 0.022 mass %, effects of greatly strengthening with respect to Comparative Sample No. 1 was not sufficient. That is, in the titanium alloy member having a plate-like structure, 0.02 to 0.09 mass % of nitrogen is preferably contained in solid solution for highly strengthening.

In Sample No. 201 which contained 0.023 mass % of nitrogen, the maximum three-point bending stress was very high compared to that of Comparative Sample 2. The maximum three-point bending stress increased as the amount of nitrogen increased. However, in Sample No. 207 which contained 0.121 mass % of nitrogen, the material was embrittled due to reduction of ductility, the maximum three-point bending stress was lower than that of Comparative Sample No. 2. In the cases in which nitrogen was further contained, the maximum three-point bending stress further decreased due to further embrittlement. When the amount of nitrogen was less than 0.023 mass %, the effect of highly strengthening with respect to Comparative Sample No. 2 was not sufficient. Therefore, in the titanium alloy member having a fine acicular structure, 0.02 to 0.12 mass % of nitrogen is preferably contained in solid solution for it to have very high strengthening.

FIG. 5 shows a relationship between the sintering temperature and the maximum three-point bending stress. In Sample No. 109 in which the sintering temperature was 800° C., even though 0.076 mass % of nitrogen was contained, the maximum three-point bending stress was lower than that of Comparative Sample No. 1. According to observation of the structure, deformation of the nitrogen-containing titanium alloy fiber and the titanium alloy fiber was not sufficient since the sintering temperature was low, whereby a large number of pores remained. Furthermore, boundaries were clearly observed at the bonding portions of the nitrogen-containing titanium alloy fiber and the titanium alloy fiber, the bonding portions of the nitrogen-containing titanium alloy fibers, and the bonding portions of the titanium alloy fibers. That is, large numbers of pores remained and progress of sintering at the bonding portions of the fibers was insufficient, whereby the strength was lowered. In Sample No. 110 in which the sintering temperature was 900° C., the maximum three-point bending stress was higher than that of Comparative Sample 1. In Samples Nos. 111 to 113 in which the sintering temperature was 1000° C. or more, pore was hardly remained and progress of the sintering at the bonding portions of the fibers was sufficient, whereby high maximum three-point bending stress was obtained. Therefore, in the titanium alloy member having a plate-like structure, the sintering temperature is preferably at least 900° C., and more preferably, it is 1000 to 1300° C., to provide very high strengthening.

In Sample No. 209 in which the sintering temperature was 800° C. and the heat treatment was followed, even though the amount of nitrogen was 0.076 mass %, the maximum three-point bending stress was lower than that of Comparative Sample No. 2. The reason is that a large number of pores remained and progress of the sintering at the bonding portions of the fibers was insufficient as well as in Sample No. 109. In Sample No. 210 in which the sintering temperature was 900° C. and the heat treatment followed, the maximum three-point bending stress was much higher than that of Comparative Sample No. 2. In Samples Nos. 211 to 213 in which the sintering temperature was 1000° C. or more and the heat treatment followed, pores hardly remained and progress of the sintering at the bonding portions of the fibers was sufficient, whereby high maximum three-point bending stress was stably obtained. Therefore, in the titanium alloy member having the fine acicular structure, the sintering temperature is preferably is at least 900° C., and more preferably, is 1000 to 1300° C., to provide very high strengthening.

INDUSTRIAL APPLICABILITY

The high-strength titanium alloy material of the present invention is applicable for materials used for aircrafts and automobiles required to have light weight and high strength and materials for bioimplant devices.

The invention claimed is:

1. A titanium alloy member comprising:

a fine acicular structure; and 0.054 to 0.093 mass % of nitrogen contained in solid solution, wherein the fine acicular structure includes acicular crystals having a thickness of 5 μm or less, the fine acicular structure consists of a β phase of which an area ratio is 0.1 to 1.0%, the balance being only α phase, and the alloy member has a bending strength of 2286 to 2318 MPa in a three-point bending test.

2. The titanium alloy member according to claim 1, wherein the alloy member is yielded from a titanium alloy selected from Ti-6Al-4V, Ti-3Al-2.5V, Ti-4Al-3Mo-1V, Ti-5Al-2Cr-1Fe, Ti-5Al-1.5Fe-1.5Cr-1.5Mo, Ti-6Al-Nb-1Ta-1Mo, Ti-8Al-1Mo-1V, Ti-8Al-4Co, Ti-6Al-2Xn-4Zr-2Mo, Ti-6Al-6V-2Sn, and Ti-6Al-2Sn-4Zr-6Mo.

3. The titanium alloy member according to claim 1, containing no TiN phase.

4. A production method for a titanium alloy member according to claim 1, the method comprising:

preparing a titanium alloy material;

separating a portion of the titanium alloy material and nitriding the portion, thereby forming at least a nitrogen solid solution layer in a surface layer of the portion, thereby yielding a nitrogen-containing titanium alloy material;

mixing the titanium alloy material and the nitrogen-containing titanium alloy material, thereby yielding a titanium alloy material mixed with nitrogen-containing titanium alloy material;

sintering the titanium alloy material mixed with nitrogen-containing titanium alloy material, thereby bonding the materials together and dispersing nitrogen contained in the nitrogen-containing titanium alloy material and forming a sintered body in a condition in which nitrogen is uniformly dispersed into an entire inner portion of the sintered body by solid solution, and subjecting the sintered body to solution heat treatment and annealing treatment in this order, thereby obtaining a titanium alloy member having a fine acicular structure.

5. The production method for a titanium alloy member according to claim 4, wherein the titanium alloy material for sintering is titanium alloy fiber obtained by a molten metal extraction method.

6. The production method for a titanium alloy member according to claim 4, wherein the solution heat treatment is performed at a temperature within 100° C. from a β transus temperature, and the annealing treatment is performed in a temperature range of 450 to 750° C.

7. The production method for a titanium alloy member according to claim 4, wherein the titanium alloy member after the solution heat treatment has a martensitic structure.

8. The production method for a titanium alloy member according to claim 4, wherein the titanium alloy member after the solution heat treatment mainly has a structure of an α' phase (hexagonal martensitic crystal) as a main structure.

9. The production method for a titanium alloy member according to claim 4, wherein the sintering is performed by hot pressing.

10. The production method for a titanium alloy member according to claim 9, wherein the hot pressing is performed in a temperature range of 900 to 1300° C.

* * * * *